US009375633B2

(12) United States Patent
Carlson

(10) Patent No.: US 9,375,633 B2
(45) Date of Patent: Jun. 28, 2016

(54) SKATEBOARD DECK REINFORCEMENT APPARATUS AND METHOD

(71) Applicant: Daniel Brooks Carlson, Cave Creek, AZ (US)

(72) Inventor: Daniel Brooks Carlson, Cave Creek, AZ (US)

(73) Assignee: Daniel Brooks Carlson, Cave Creek, AZ (US)

( * ) Notice: Subject to any disclaimer, the term of this patent is extended or adjusted under 35 U.S.C. 154(b) by 0 days.

(21) Appl. No.: 14/305,705

(22) Filed: Jun. 16, 2014

(65) Prior Publication Data

US 2015/0360119 A1 Dec. 17, 2015

(51) Int. Cl.
*A63C 17/00* (2006.01)
*A63C 17/01* (2006.01)

(52) U.S. Cl.
CPC ..... *A63C 17/017* (2013.01); *A63C 17/012* (2013.01); *Y10T 29/4962* (2015.01)

(58) Field of Classification Search
CPC .... A63C 17/01; A63C 17/012; A63C 17/014; A63C 17/015; A63C 17/016; A63C 17/017; Y10T 29/4962
See application file for complete search history.

(56) References Cited

U.S. PATENT DOCUMENTS

| | | | | |
|---|---|---|---|---|
| 6,621,419 | B2 * | 9/2003 | Chiu | 340/815.42 |
| 7,007,977 | B1 * | 3/2006 | Gallagher | 280/809 |
| 7,159,879 | B2 * | 1/2007 | Cole | 280/87.042 |
| 7,198,280 | B2 * | 4/2007 | Hara | 280/87.042 |
| 7,810,825 | B2 * | 10/2010 | Cole | 280/87.042 |
| 8,157,274 | B2 * | 4/2012 | Chen | 280/87.041 |
| 8,459,669 | B2 * | 6/2013 | Lin | 280/87.042 |
| 8,857,831 | B1 * | 10/2014 | Rotondo | 280/87.042 |
| 8,870,199 | B2 * | 10/2014 | Fehn | 280/87.042 |
| 8,915,506 | B2 * | 12/2014 | Piaceski et al. | 280/87.042 |
| 8,925,936 | B1 * | 1/2015 | Clos et al. | 280/87.042 |
| 9,004,213 | B2 * | 4/2015 | Larson et al. | 180/181 |
| 2003/0185019 | A1 * | 10/2003 | Rogers et al. | 362/545 |
| 2003/0201620 | A1 * | 10/2003 | Seelye | 280/87.042 |
| 2004/0140633 | A1 * | 7/2004 | Beedle et al. | 280/11.27 |
| 2005/0211078 | A1 * | 9/2005 | Iwai et al. | 84/723 |
| 2006/0091634 | A1 * | 5/2006 | Cole | 280/87.042 |
| 2007/0182118 | A1 * | 8/2007 | Cole | 280/87.042 |
| 2008/0036165 | A1 * | 2/2008 | Reinson | 280/87.042 |
| 2008/0191438 | A1 * | 8/2008 | Piaceski et al. | 280/87.042 |
| 2009/0206572 | A1 * | 8/2009 | Cole | 280/87.042 |
| 2009/0236811 | A1 * | 9/2009 | Lewis | 280/87.042 |
| 2010/0171298 | A1 * | 7/2010 | Chen | 280/786 |
| 2011/0221150 | A1 * | 9/2011 | Harris | 280/87.042 |
| 2012/0146304 | A1 * | 6/2012 | Fehn | 280/87.042 |
| 2013/0305790 | A1 * | 11/2013 | Seele et al. | 70/58 |
| 2014/0321150 | A1 * | 10/2014 | Sandiford | 362/545 |

* cited by examiner

*Primary Examiner* — Hau Phan
*Assistant Examiner* — Jacob Meyer
(74) *Attorney, Agent, or Firm* — Michael K. Kelly; Jenning Strouss & Salmon, PLC

(57) ABSTRACT

A structural reinforcement device for a skateboard of the type including a deck having a bottom surface having a first bolt pattern and a truck including a baseplate having a second bolt pattern. The reinforcement device includes a rigid insert having a third bolt pattern aligned with the first and second bolt patterns and disposed between the baseplate and the bottom surface of the deck. The baseplate is characterized by a leading edge, and the rigid insert extends forward of the leading edge to effectively increase the surface area of contact between the baseplate and deck, thereby reducing stress concentrations near the fastening bolts.

10 Claims, 4 Drawing Sheets

SKATEBOARD DECK REINFORCEMENT APPARATUS AND METHOD

TECHNICAL FIELD

Embodiments of the subject matter described herein relate generally to skateboard decks and their associated hardware and, more particularly, to a structural reinforcement device for insertion between the bottom of the skateboard deck and the attached truck assembly for mitigating localized stresses which may result in cracks and overall failure in the deck.

BACKGROUND

Recreational and competitive skateboarding requires increasingly robust hardware, particularly to facilitate tricks and maneuvers which impart high impact and high torque loads to the skateboard. Risers are used to increase the space between the truck and the deck, allowing the truck to twist further without causing wheel bite, i.e., when the wheel touches the deck and stops rotating. Wedges can be used to change the turning characteristics of a truck. Risers and wedges, due to their intended function, are therefore necessarily constructed of resilently deformable materials such as foam, plastic, or rubber.

High stress concentrations on skateboard decks near the truck assembly baseplates can be especially problematic as well as costly. The failure of skateboards is often caused by increased stress concentrations around the bolt holes as the result of torque applied to the skateboard deck about the edge of the truck baseplate, particularly when landing slightly off center of the bolt holes.

Methods and apparatus are thus needed winch address these shortcomings of presently known skateboard hardware.

BRIEF DESCRIPTION OF THE DRAWING FIGURES

A more complete understanding of the subject matter may be derived by referring to the detailed description and claims when considered in conjunction with the following figures, wherein like reference numbers refer to similar elements throughout the figures, and;

DETAILED DESCRIPTION

Figure 1:
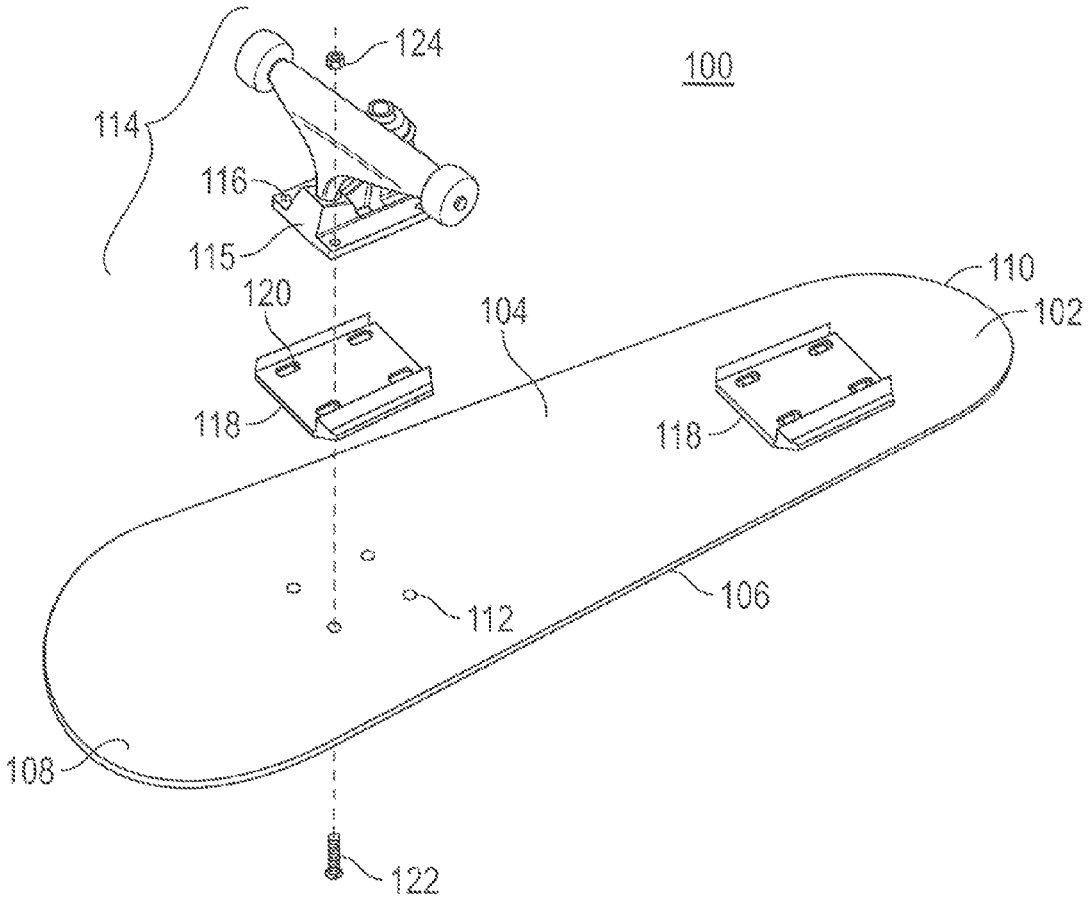
FIG. 1 is an exploded perspective view of a skateboard deck, truck assembly, and a rigid structural insert disposed therebetween prior to assembly in accordance with an embodiment.

A structural reinforcement device is provided for use with a skateboard of the type which includes a deck having a bottom surface and a first plurality of holes corresponding to a bolt pattern, and a truck including a baseplate having a second plurality of holes corresponding to the bolt pattern. The reinforcement device includes a rigid insert having a third plurality of holes substantially corresponding to the bolt pattern and disposed between the baseplate and the bottom surface of the deck.

In an embodiment, the baseplate is characterized by a first leading edge, and at least a portion of the rigid insert extends forward of the first leading edge of the baseplate and flush with the bottom surface of the deck. The rigid insert may also include a second leading edge configured to extend forward of the first leading edge of the baseplate.

In accordance with another aspect, the baseplate is further characterized by an aft edge and respective first and second sides extending between the leading edge and the aft edge, the first and second sides being separated by a side-to-side distance; and at least a portion of the rigid insert has a width greater than the side-to-side distance and is configured to extend beyond the first and second sides of the baseplate, respectively.

In an embodiment, the baseplate includes a rectangular surface having a fore-to-aft distance and a side-to-side distance, the rectangular surface configured for mating engagement with the bottom surface of the deck; and the rigid insert includes a first portion extending in the fore-to-aft direction and having an extent greater than the fore-to-aft distance, and a second portion extending in the side-to-side direction and having an extent greater than the side-to-side distance.

According to a further aspect, the baseplate includes a rectangular surface having a fore-to-aft distance and a side-to-side distance, the rectangular surface configured for mating engagement with the bottom surface of the deck; and the rigid insert is a substantially rectangular, substantially planar substrate having a length dimension and a width dimension, at least one of which exceeds the corresponding baseplate dimension.

In an embodiment, the baseplate includes a rectangular surface having a fore-to-aft distance and a side-to-side distance, the rectangular surface configured for mating engagement with the bottom surface of the deck; the rigid insert comprises a substantially rectangular, substantially planar substrate having a length dimension greater than the fore-to-aft distance, and a width dimension greater man the side-to-side distance; and the rigid insert further comprises respective fore-to-aft extending rigid side edges, each having a thickness greater than the thickness of the remaining portion of the rigid insert.

In accordance with a further aspect, the third plurality of holes may be oblong, and the rigid insert includes an intersection of a fore-to-aft side edge and a leading edge or an aft edge, wherein the intersection comprises a chamfer, a fillet, or both.

In another embodiment, the third plurality of holes comprises two forward holes spaced apart by a distance in the range of about 1⅜inches to about 1⅞inches, and preferably about 1⅝inches. The third plurality of holes may also include two aft holes spaced, apart -from the forward holes by a distance in the range of about 2 inches to about 2¼inches, and preferably about 2⅛inches.

According to another aspect, the rigid insert may be made from any suitable non-resiliently deformable material such as, for example, aluminum or any other metal or metal compound or alloy, as well as polymers and/or composites having sufficient rigidity to resist plastic deformation.

In another embodiment, each of the third plurality of holes has a cross-sectional area at least as great as the corresponding cross-sectional areas of each of the second plurality of holes, respectively.

In another embodiment, the rigid insert comprises a substantially rectangular and substantially planar substrate having an interior region disposed within the third plurality of holes, the interior region characterized by rigid insert material removed to any desired depth to form a symbol, insignia, trademark, logo, alphanumeric character, or the like.

In another embodiment, the rigid insert is made from a single piece construction, which may include two or more fore-to-aft extending structural ribs outside of and raised above, the surface which mates to the baseplate, and wherein the ribs overlap fore-to-aft side edges of the baseplate.

According to another aspect, the rigid insert may be made from a multiple piece construction, in which fore-to-aft structural ribs may comprise any suitable material with alternate desired properties (predominantly structural) from that of the area in which the truck baseplate mates with the bottom of the skateboard deck. The ribs may be bonded, brazed, or otherwise mechanically affixed to the remainder of the baseplate.

A skateboard is also provided which includes a deck having a bottom surface and a first plurality of through holes corresponding to a bolt pattern; a truck assembly including a baseplate having a second plurality of through holes corresponding to the bolt pattern; and a rigid insert having a third plurality of through holes corresponding to the bolt pattern and disposed between the bottom surface of the deck and the baseplate.

In an embodiment, the baseplate is characterized by a first leading edge; and a least a portion of the rigid insert is configured to extend forward of the first leading edge of the baseplate. The baseplate may also include a rectangular surface having a fore-to-aft distance and a side-do-side distance, the rectangular surface configured for mating engagement with the bottom surface of the deck. The rigid insert may be in the form of a substantially rectangular, substantially planar substrate having a length dimension and a width dimension, at least one of which exceeds the corresponding baseplate dimension.

A method is also provided for structurally reinforcing a skateboard deck of the type which includes a pattern of holes for attaching a truck assembly to a bottom surface of the skateboard deck. The method may involve; providing a non-deformable insert; placing the insert between the bottom of the skateboard deck and the truck assembly; and securing the truck assembly to the bottom of the skateboard deck with the insert interposed between the bottom of the skateboard deck and the truck assembly.

In an embodiment, the method may also involve removing the truck assembly from the deck; aligning a first bolt pattern on the deck with a second bolt pattern on the insert with the insert flush against the deck; aligning a third bolt pattern on the truck assembly with the second bolt pattern on the insert; inserting boils into the aligned first, second, and third bolt patterns; and reattaching the truck assembly to the deck with the insert disposed between the truck assembly and the deck.

In accordance with an aspect, the truck assembly may Include a baseplate having a leading edge, and the insert may be configured to extend forward of the leading edge upon reattaching the truck assembly to the deck.

In accordance with various aspects of the present invention, a device placed between a skateboard truck assembly and the skateboard deck functions to increase the effective surface area of the truck baseplate in contact with the deck, thereby enhancing the structural support of the deck where torque about the inner edge of the baseplate due to landing off center often causes the deck to crack, delaminate, or otherwise fail. The combination of a conventional deck, a conventional truck baseplate, and foe novel rigid insert described herein reinforces the deck and provides prolonged service life of the skateboard, and facilitates the reusability and interchangeability between any skateboard deck avid truck assembly, regardless of the manufacturer.

In contrast to presently known risers or wedges, which are designed to be resiliently deformable to facilitate twisting and turning, the insert described herein is of rigid construction, and effectively extends the baseplate, In order to reduce stress concentrations surrounding the bolt(s) which attaches the truck to the deck. Thus, in the context of this disclosure, the terms "rigid" and "non-bendable" imply that the insert does not undergo appreciable deformation during normal or high impact skateboard operation; that is, the insert essentially exhibits structural integrity similar to that of the truck baseplate.

Turning now to FIG. 1, an exemplary skateboard 100 includes a deck 102, a truck, assembly 114, and a rigid insert 118. More particularly, the deck 102 includes a bottom surface 104, a circumferential edge 106, a front (fore) end 108, a rear (aft) end 110, and a bolt hole pattern 112. The truck assembly 114 includes a baseplate 115 having a bolt hole pattern 116 designed to align with the corresponding bolt hole pattern 112 of the deck during assembly. A second rigid insert 118 is positioned proximate the location of the rear truck assembly (not shown).

With continued reference to FIG. 1, the rigid insert 118 includes a bolt hole pattern 120 which generally corresponds to the bolt hole pattern 112 of the deck and the bolt hole pattern 116 of the truck. During assembly, the three respective bolt hole patterns are aligned and a respective bolt 122 and associated nut 124 is secured within each bolt hole to attach the truck assembly 114 to the deck 102 with the rigid insert 118 disposed therebetween. In a preferred embodiment, the holes in the bolt hole pattern 120 of the rigid insert 118 may be oblong, elliptical, or otherwise exhibit a lengthwise (fore-to-aft) dimension greater than the width to allow the rigid insert to be attached to the deck at any one of a number of locations relative to the leading edge of the truck baseplate 115, as described in greater detail below in conjunction with FIG. 2.

Figure 2:
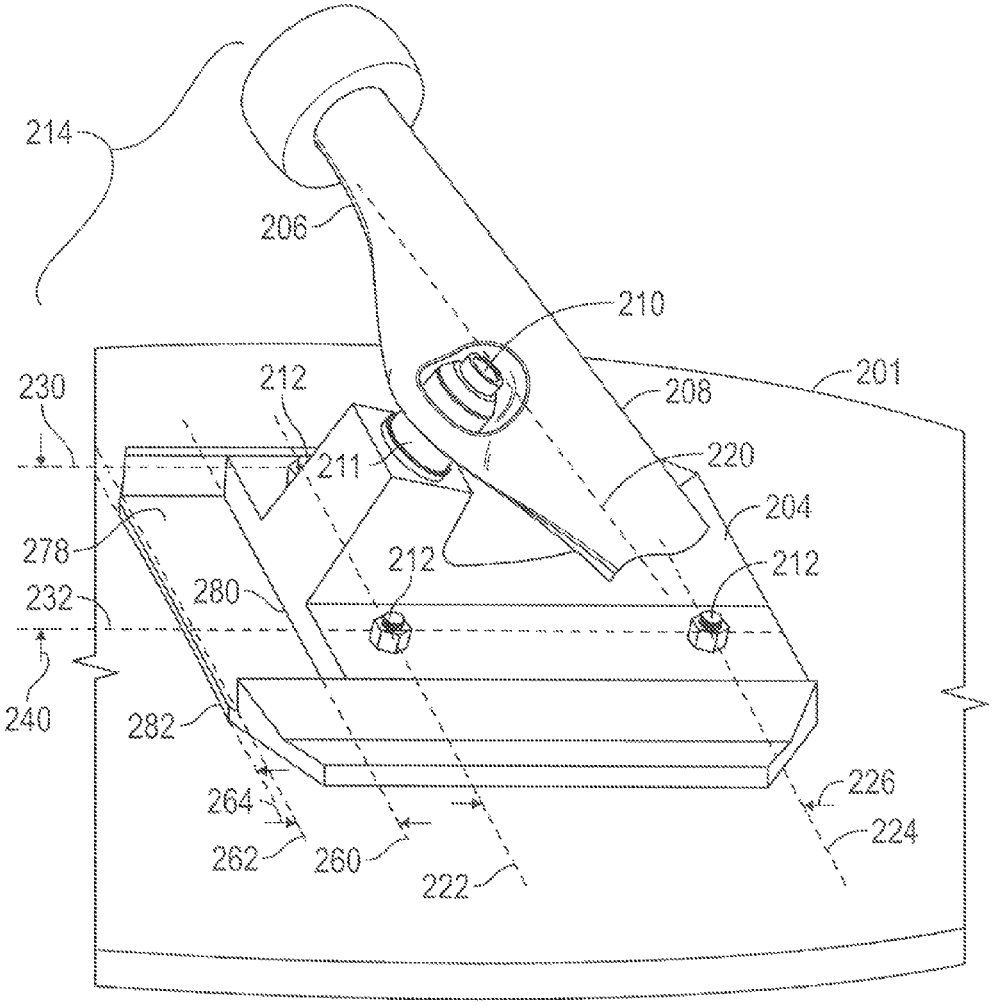
FIG. 2 is a perspective view of the truck assembly and structural insert of FIG. 1, shown mounted to a skateboard deck in accordance with an embodiment.

FIG. 2 is a perspective view of the truck assembly and structural insert of FIG. 1, shown mounted to a skateboard, deck, in accordance with an embodiment. More particularly, FIG. 2 illustrates a truck assembly 214 and a structural insert 278 attached to a deck 201 by a respective bolts 212 which extend thru a similar bolt hole pattern in each of the deck, truck assembly, and structural insert.

The truck assembly 214 includes a baseplate 204, a hanger 208 including an axel 206 with axis 220, a grommet or bushing 211, and a kingpin 210 for securing the hanger and grommet to the baseplate. Although not visible in FIG. 2, the bolt holes in the insert 278 may be circular or, alternatively, they maybe oblong to permit precise positioning of the insert 278 with respect to the baseplate 204.

In particular, the baseplate 204 includes a first leading edge 280 which, when secured to the deck, is disposed along a line 260. The insert 278 includes a second leading edge 282 which, when secured to the deck, is disposed along a line 262. The distance 264 between line 260 and line 262 may be set by the user by sliding the insert 278 perpendicular to the edge 280 in FIG. 2 prior to securing the assembly in place with the bolts 212. Those skilled in the art will appreciate that the greater the distance 264, the more the stress concentrations due to torque about the baseplate edge 280 is relieved during high impact and high stress skateboard maneuvers. This is due in part to the fact that a greater distance 264 functions to increase the effective surface area of contact between the truck assembly and the bottom of the deck.

With continued reference to FIG. 2, the nominal distance between the hour (fore) bolt holes 212 (along a line 222), on the one hand, and the rear (aft) bolt holes 212 (the fourth aft bolt is not visible in FIG. 2) along a line 224 is indicated by a distance 226. In many conventional skateboard designs, this distance 226 may be in the range of 1¾ inches to 2½inches, and preferably about 2⅛inches. Similarly, the nominal distance between the left side bolt holes 212 (along a line 232), on the one hand, and the right side bolt holes along a line 230 is indicated by a distance 240. The distance 240 is conventionally in the range of 1¼to 1⅞inches, and preferably about 1⅝inches.

Figure 3:
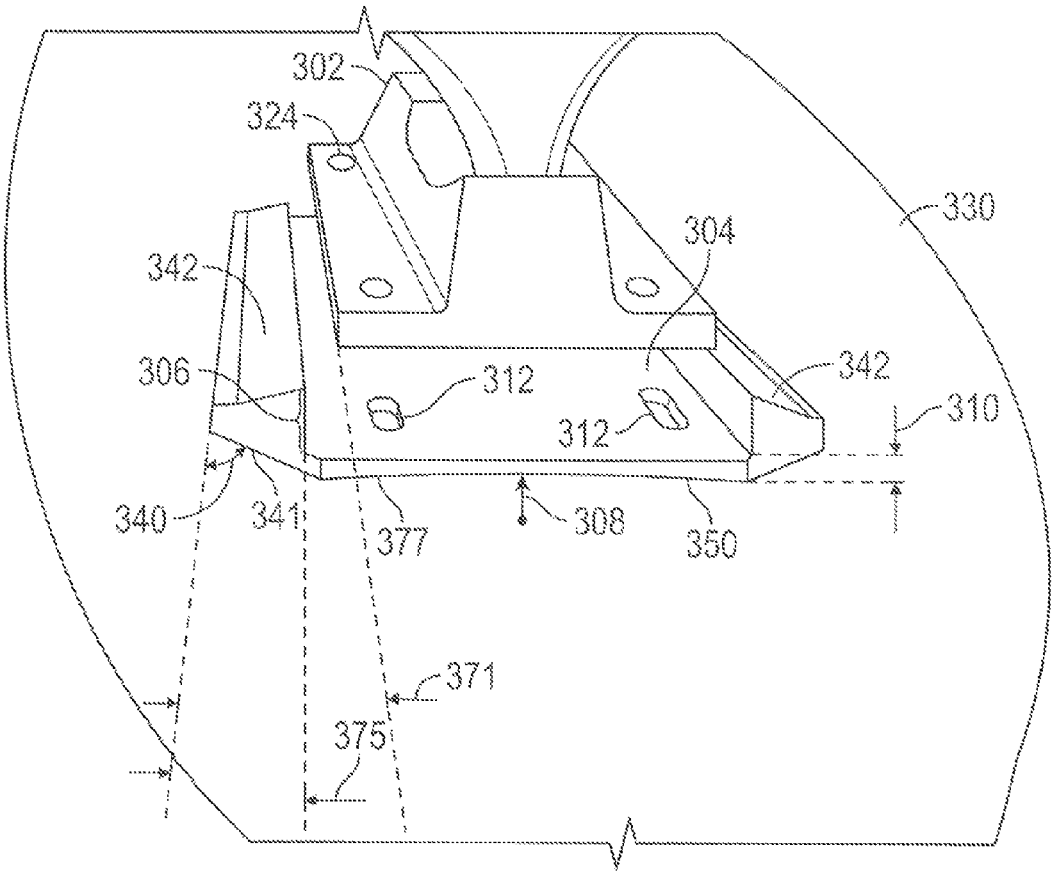
FIG. 3 is an exploded front perspective view of a truck baseplate and structural insert aligned for mourning to a deck in accordance with an embodiment.

FIG. 3 is an exploded front perspective view of a truck baseplate and structural insert aligned for mounting to a deck in accordance with an embodiment. More particularly, FIG. 3 illustrates a truck baseplate 302 having bolt holes 324 and a structural insert 304 having bolt holes 312 configured for attachment to a deck 330. In the illustrated embodiment the baseplate bolt holes 324 are conventionally circular, whereas the structural insert bolt holes 312 are oblong in the fore-to-aft direction to allow for precise positioning.

The insert 304 further includes a pair of fore-to-aft ribs 342 to provide enhanced structural support. Each rib may have a dimension 375 in the range of zero to 0.500 inches or more. The amount by which the side-to-side dimension of the insert exceeds the side-to-side dimension of the baseplate is shown as distance 371, and may range thorn zero to about 0.500 inches or more. In the illustrated embodiment, the ribs extend along the entire length of the insert. Alternatively, the ribs may extend along only a portion of the insert, for example, in the vicinity of the bolt holes (see FIG. 4). The ribs 342 are characterized by a step height 306, for example, on the order of zero to 0.500 inches, and preferably about 0.250 inches.

A bottom surface 377 of the insert 304 may be planar or, alternatively, may exhibit a radius 308 to match that of the deck such as, for example, on the range of 25 inches to infinity (flat). The inner portion 350 of the insert, between the ridges 342, may have a thickness 310 in the range of 0.010 to 0.250 inches, and preferably about 0.065 inches which may be variable depending on the radius 308, with the thinnest point in the center. Some or all of the corners of the insert 304 may include a chamfer or fillet, or a combination of both, 341 cut at an angle 340 in the range of, for example, 15°-75°, and preferably about 45°. The chamfer or fillet may extend beyond the corners of the insert by any desired amount up to and including a full circular configuration of the insert.

Figure 4:
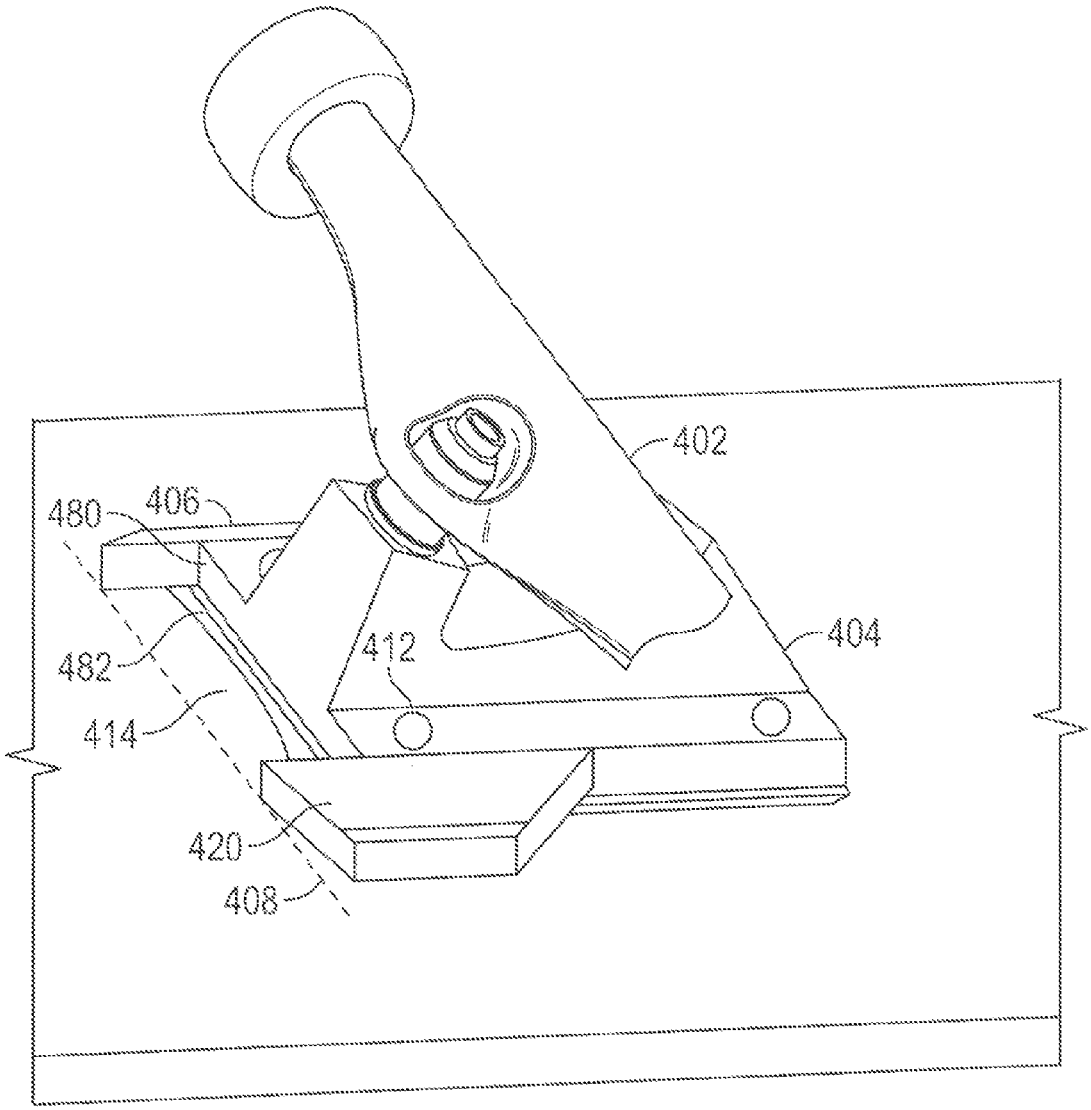
FIG 4 is an alternate embodiment of the structural insert shown in FIG. 2 in accordance with an embodiment.

FIG. 4 is an alternate embodiment of the structural insert shown in accordance with an embodiment. More particularly, FIG. 4 illustrates a truck 402 including a baseplate 404 having bolt holes 412 and a first leading edge 480, and a structural insert 406 having one or more truncated ridges 420. In the illustrated embodiment, the truncated ridge 420 is proximate one of the bolt holes 412. A second leading edge of the insert 406 is defined by a line 408, and a void 414 extends from the leading edge line 408 rearward to an insert edge 482. Removing unnecessary metal in this fashion allows for a more lightweight insert, while preserving the structural characteristics of the insert.

The inserts disclosed herein provide additional structural support to skateboard decks in the higher stress regions around the truck baseplate. In particular, the edge of the baseplate closest to the bolt holes is a typical location for deck fatigue, failure, cracks, and/or delamination. When installed, the rigid insert of the present invention sets to increase the effective surface area of the baseplate proximate the mounting holes. To account for slight differences in a variety of baseplate and deck models and manufacturers, various embodiments of the insert employ a combination of holes or slots to allow for precise positioning of the insert relative to the front and back edges of the baseplate.

The foregoing description is merely illustrative in nature and is not intended to limit the embodiments of the subject matter or the application and uses of such embodiments. Furthermore, there is no intention to he bound by any expressed or implied theory presented in the technical field background, or the detailed description. As used herein, the word "exemplary" means "serving as an example, instance, or illustration." Any implementation described herein as exemplary is not necessarily to be construed as preferred or advantageous over other implementations, and the exemplary embodiments described herein are not intended to limit the scope or applicability of the subject matter in any way.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application. Accordingly, details of the exemplary embodiments or other limitations described above should not be read into the claims absent a clear indention to the contrary.

The invention claimed is:

1. A structural reinforcement device for use with a skateboard, the skateboard comprising:

a deck having a bottom surface and a first plurality of holes corresponding to a bolt pattern; and a truck including a baseplate having a second plurality of holes corresponding to the bolt pattern;

the structural reinforcement device comprising:

a rigid insert having a third plurality of holes substantially corresponding to the bolt pattern, the rigid insert configured to be disposed between the base plate and the bottom surface of the deck;

wherein the rigid insert comprises a metallic material which is non-bendable and not resilient deformable, and which exhibits structural integrity similar to that of the truck baseplate; wherein: the base plate is characterized by a first leading edge; and the rigid insert comprising a second leading edge configured to extend forward of the first leading edge; the baseplate is further characterized by an aft edge and respective first and second sides extending between the leading edge and the aft edge, the first and second sides being separated by a side-to-side distance; and at least a portion of the rigid insert has a width greater that the side-to-side distance and configured to extend beyond the fist and second side of the baseplate, respectively; where the rigid insert comprises repective structural reinforcement ribs extending in the fore-to-aft direction along opposing sides of the rigid insert; and furthermore, the baseplate, when installed on the skateboard deck, is fixed to the rigid insert.

2. The reinforcement device of claim 1, wherein:

the rigid insert comprises aluminum.

3. The reinforcement device of claim 1, wherein:

the baseplate includes a rectangular surface having a fore-to-aft distance and a side-to-side distance, the rectangular surface configured for mating engagement with the bottom surface of the deck;

the rigid insert comprises a substantially rectangular, substantially planar substrate having a length dimension greater than the fore-to-aft distance, and a width dimension greater than the side-to-side distance; and the rigid insert further comprises an interior portion bounded by the fore-to-aft extending rigid structural reinforcement ribs, each having a thickness greater than the thickness of the interior portion of the rigid insert.

4. The reinforcement device of claim 3, wherein:

the structural reinforcement ribs have a thickness in the range of up to .5 inches.

5. The reinforcement device of claim 3, wherein:

the rigid insert comprises an intersection of a fore-to-aft side edge and one of a leading edge and an aft edge, the intersection comprising one of a chamfer and a fillet defining an angle in the range of 45 degrees with respect to the second leading edge.

6. The reinforcement device of claim 3, wherein:

the third plurality of holes comprises two forward holes spaced apart by a distance in the range of about 1⅜ inches to about 1⅞ inches, and two aft holes spaced apart from the forward holes by a distance in the range of about 2 inches to about 2¼ inches.

7. The reinforcement device of claim 3, wherein:

the rigid insert is made from one of metal, polymer, composite, alloy, and any combination thereof.

8. The reinforcement device of claim 3, wherein:

each of the third plurality of holes comprises a cross-sectional area at least as great as the corresponding cross-sectional areas of each of the second plurality of holes, respectively.

9. The reinforcement device of claim 3, wherein:

the rigid insert comprises a substantially rectangular, substantially planar substrate having an interior region disposed within the third plurality of holes, the interior region characterized by rigid insert material removed to form one of a symbol, insignia, trademark, logo, and an alphanumeric character.

10. The reinforcement device of claim 1, wherein:

the rigid insert comprises a single piece construction having at least one fore-to-aft structural rib which extends sideways beyond the baseplate.

* * * * *